United States Patent [19]

Bennett et al.

[11] Patent Number: 4,646,672

[45] Date of Patent: Mar. 3, 1987

[54] SEMI-SUBERSIBLE VESSEL

[76] Inventors: William Bennett; Walter Michel, both of 935 Gravier St., New Orleans, La. 70112

[21] Appl. No.: 567,228

[22] Filed: Dec. 30, 1983

[51] Int. Cl.[4] ..... B63B 35/44

[52] U.S. Cl. ..... 114/264; 114/265

[58] Field of Search ..... 114/265, 264, 266, 125; 175/7, 8, 85, 6; 414/22; 166/367, 350, 359, 352; 405/224, 211, 217

[56] References Cited

U.S. PATENT DOCUMENTS

| | | | |
|---|---|---|---|
| 1,749,958 | 3/1930 | Randell | 114/265 |
| 3,207,110 | 9/1965 | Laborde et al. | 114/265 |
| 3,709,307 | 1/1973 | Clark | 175/8 |
| 3,771,481 | 11/1973 | Goren et al. | 114/265 |
| 3,872,814 | 3/1975 | Rodriguez | 114/265 |
| 3,895,677 | 7/1975 | Bokenkamp | 175/85 |
| 3,946,684 | 3/1976 | Summer | 114/265 |
| 3,949,693 | 4/1976 | Bauer et al. | 114/265 |
| 3,987,910 | 10/1976 | Brunato | 175/85 |
| 4,044,895 | 8/1977 | Adair | 414/22 |
| 4,457,250 | 7/1984 | Oshima et al. | 114/265 |

OTHER PUBLICATIONS

Ocean Industry, Dec. 1983, p. 86, "New Generation Semi Design for 10,000-Ft. Waters".

*Primary Examiner*—Trygve M. Blix

*Assistant Examiner*—Edwin L. Swinehart

*Attorney, Agent, or Firm*—Keaty & Keaty

[57] ABSTRACT

An improved semi-submersible unit for use in offshore operations which has a significantly reduced susceptability to heave motions in wave periods which are most likely to be encountered during practical operation conditions. The unit consists of a lower hull or hulls supporting vertical buoyant caisson which also support an upper deck or platform which supports and is supported by a centrally disposed, large diameter buoyant caission which contributes a significant portion of the total water plane area of the vessel when it is submerged to its operational draft. The vessel may be configured for offshore drilling operations, diving support, and various other offshore support functions. When configured for the offshore drilling operation, the central column serves as buoyant chamber and as a primary storage chamber for tubular products which are associated with the drilling function. This clears the deck of the vessel for other operations and introduces a less hazardous method for handling tubulars than in previous designs. The central caisson has an interior annulus which is open both to the drill floor and the sea through which operations may be carried out. The improved semi-submersible vessel exhibits significantly less heave in operational wave conditions than existing semi-submersibles or similar water plane area and displacement.

13 Claims, 4 Drawing Figures

SEMI-SUBERSIBLE VESSEL

BACKGROUND OF THE INVENTION

The expansion of the drilling industry to offshore locations has led to the development of several types of drilling units. These consist of submersible drilling platforms, jack-up drilling platforms and two major classes of floating vessels. The two major classes of floating drilling vessels are those of conventional hull form or drill ships and those of semi-submersible or column stabilized units.

The drill ship is an adaptation fo a standard seagoing ship of mono-hull form with the addition of a substructure with a moon pool and/or cantilevers from which the drilling operations may be carried out. These vessels are also equipped with some additional means of positioning the unit over the drill center so that the vessel will maintain a close relationship with the bore hole in the seabed. These vessels may be held in position by either a mooring system or a dynamic positioning system. It is well known that ship type drilling units are very susceptible to wave action and will tend to move in a direct relationship with the sea state encountered. Since the vessel is connected to the seabed by a riser and the drill string is in contact with the bottom of the bore hole, motions of the vessel with respect to the seabed are extremely important to be able to maintain the drilling posture.

In response to the need for development of offshore petroleum exploration and development in increasingly more hostile and deeper water, the significance of a vessel with improved motions with respect to the seabed became apparent. For this purpose, industry has adopted and used a series of semi-submerged or semi-submersible drilling units. In essence, all of these semi-submersible drilling units or vessels comprise a wide base and totally submerged pontoons or mats. A series of vertical buoyant columns rise from this submerged base supporting a horizontal deck or platform which is maintained well above the normal expected wave crests. Upon this platform or deck, the living quarters, machinery spaces and drilling package are located. The drilling center usually consists of a cellar deck or storage area for the subsea equipment, a moon pool through which the drilling operation is carried out which is usually located in the cellar deck and a substructure which is mounted above the cellar deck area upon which the draw works, rotary and derrick are mounted. Adjacent to this area is a pipe rack area for the storage of the marine riser, drill pipe, drill collars, casing and other tubular products. The semi-submersible drilling unit is also maintained in position against the forces of the environment by use of either a fixed mooring system or an active propulsion system (dynamic positioning) a combination of the two (thruster-assisted mooring). In either case, the semi-submersible is still supported on the ocean surface by its own buoyant effect and is also suspectible to wave induced motion.

There have been recent developments in rotatable and swivable drilling units of the ship type to reduce the sensitivity of the unit to the roll and pitch motions and thereby improve their motion characteristics, thus reducing their down time for weather. These developments, however, have done little or nothing for the improvement of the heave or vertical motions of the platform with respect to the ocean floor. Many new devices have been introduced, such as motion compensators, riser tensioners and guideline tensioners which are active devices and greatly reduce the effect of the heave motion of the unit for the drilling operation. These items, however, are of a mechanical nature and do result in down time due to maintenance and also have their limits with respect to the range of sea states which they can effectively dampen.

The generally recognized design of semi-submersible platforms for minimizing the sensitivity of the unit to wave induced motions is known to consist of a lower hull or a group of pontoons upon which are deployed any number of buoyant columns arranged such that their collective water plane areas are spread significantly to provide a stable platform. The buoyancy for the unit is provided by the displacement of the lower hull or hulls and the vertical columns of the unit below the waterline. The water plane area of these vertical columns, the effective cross-sectional area of the columns at the lever of the waterline, is known to be a significant design factor for both minimizing the wave motion sensitivity and providing a stable platform with significant load carrying-capability to allow the vessel to perform its intended function. It is a trade-off between these requirements for improved motion characteristics for better drilling operations and required water plane area for a stable platform that is normally the prime concern of a naval architect with respect to the design of a semi-submersible drilling unit.

The geometric configuration of the columns of a semi-submersible unit are somewhat determined by the vessel's intended service as well as by its designer's philosophy. With increased needs for semi-submersibles on a worldwide market, it became essential to have units which were more highly mobile thus the current gereration of twin hull semi-submersibles having four, six, and eight columns evolved. The lower hulls of these units are generally of a ship shape form and during transit the unit performs similar to a catamaran type vessel.

The current state of the art attempts to reduce the motion sensitivity of the semi-submersible unit, which includes varying the shape of the buoyant columns, placing active or passive hydrodynamic dampening devices upon or within the columns and by changing the geometrical shape of the pontoons. All of these items are effective to one degree or another, however, all have their respective shortcomings.

SUMMARY OF THE INVENTION

It is the purpose of this invention to provide a revised geometrical form for constructing a semi-submersible platform of the type having submerged pontoons, vertical buoyancy columns, and an erect above the water surface work structure, so as to significantly reduce the sensitivity of the platform to wave motion effects in sea states commonly encountered during drilling operations.

Essentially this invention proposes, for a semi-submersible vessel of a given displacement and given water plane buoyancy area, to revise the geometry of the vessel by providing a buoyant center column centrally disposed about the drilling center string. It is found that if such caisson provides a significant proportion of the total water plane area of the entire array of caisson and outer buoyant columns, that the resulting vessel will exhibit significantly reduced heave motion under sea states commonly encountered in practice while retaining the semi-submersible's known resistance to combinations of roll and pitch in seas from any direction.

It is thus an object of this invention to provide an alternate construction of a semi-submersible vessel having significantly reduced heave motion in comparison to a vessel of equal displacement and water plane area of standard design.

It is a further object of this invention to provide more efficient storage and safer handling of drilling equipment and supplies, such as riser pipe and drill pipe, by utilizing the buoyant spaces within the center column for this purpose.

It is still a further object of this invention to provide extraordinary protection of the operating drill pipe and riser through the drill center, from damage due to other vessels and floating objects, by virtue of the surrounding heavy double-walled center caisson.

It is a further object of this invention to provide an alternate riser storage structure which lowers the center of gravity of the vessel, decreases wind loading effects, and alleviates adverse effects of riser handling on the vessel's trim.

It is a further object of this invention to decrease overall structural load maximums on the work platform for a given size semi-submersible vessel.

This and other objects of the invention can be seen and will be apparent from the detailed description of the preferred embodiment of the invention and from the claims.

DETAILED DESCRIPTION OF THE PREFERRED EMBODIMENT

Figure 1:
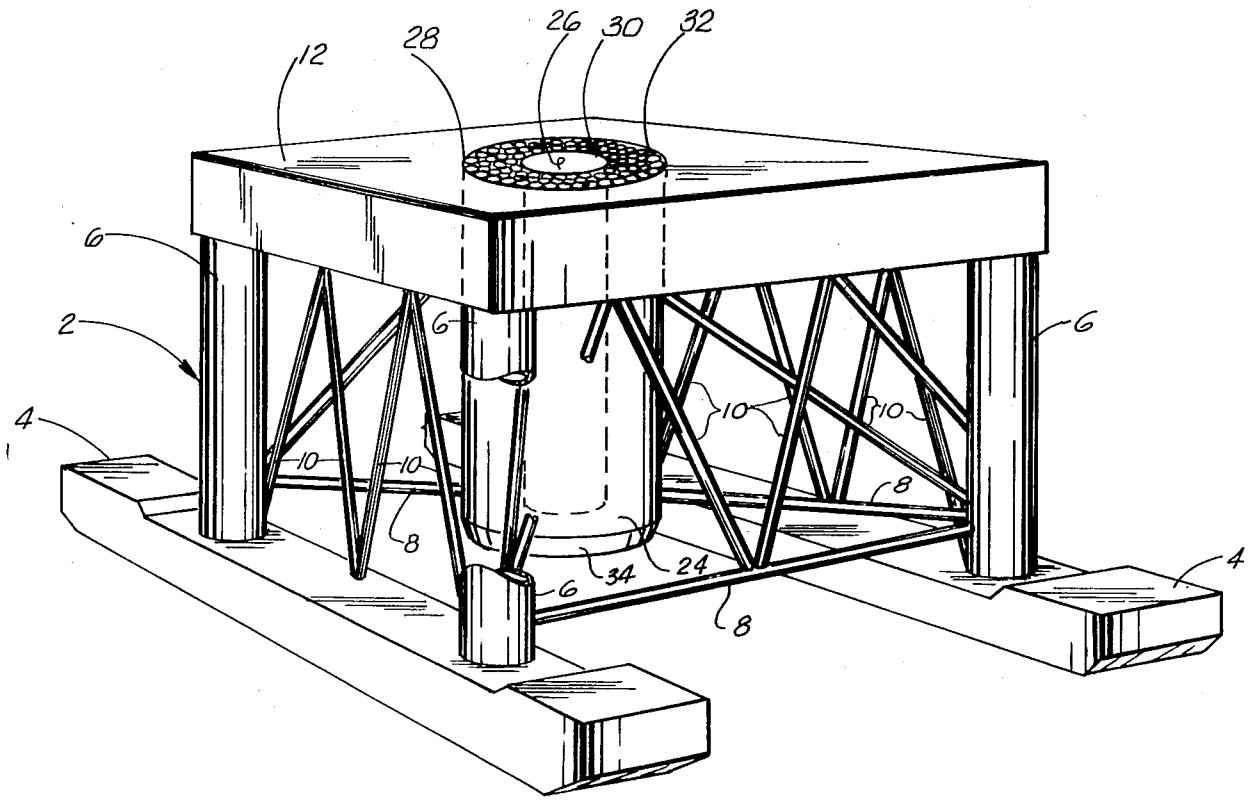
FIG. 1 is an angled view of the preferred embodiment of the invention.
Figure 2:
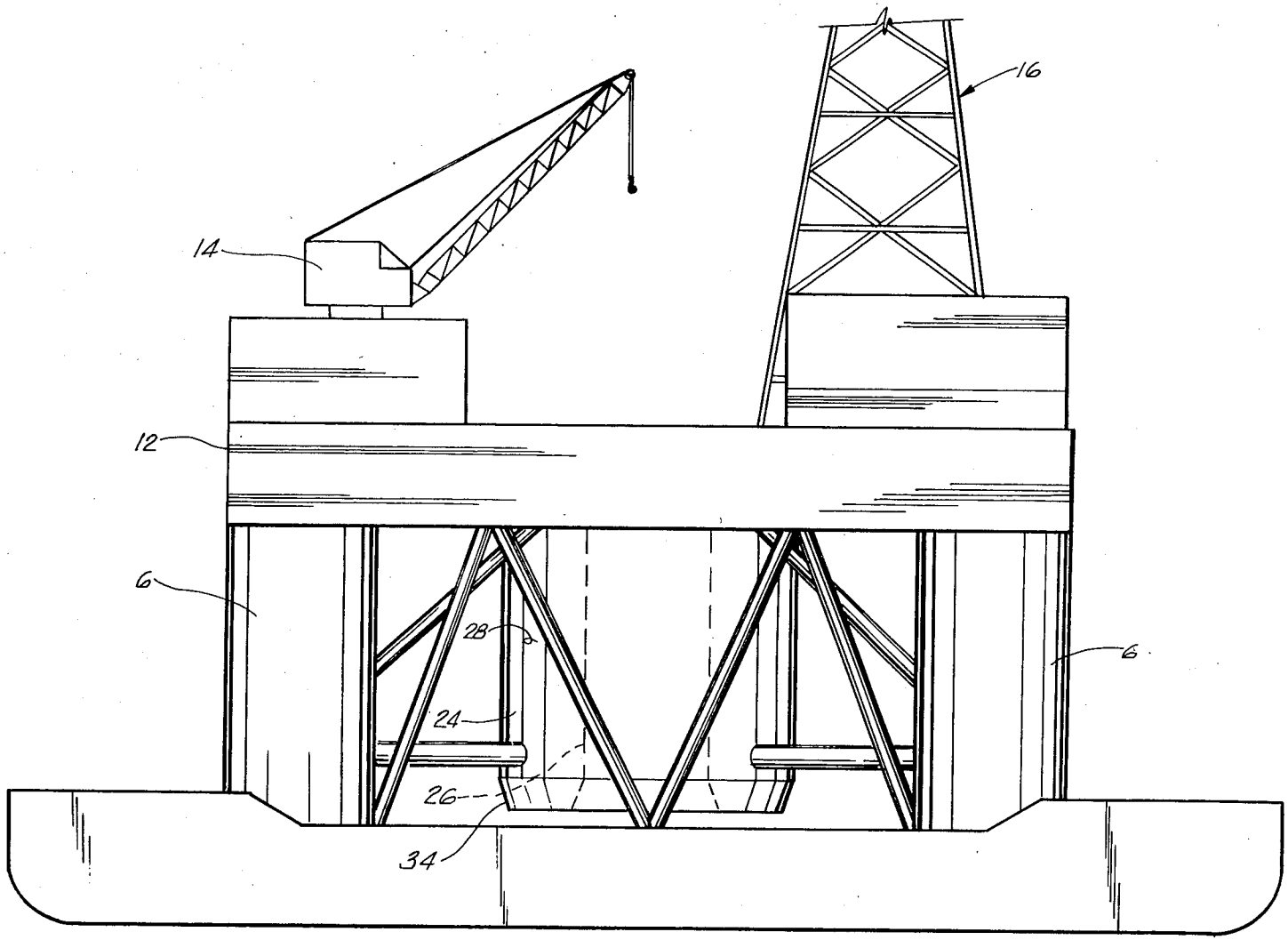
FIG. 2 is a side view of the preferred embodiment of the invention.

FIGS. 1 and 2 show a preferred embodiment as known to the inventor, of the overall semi-submersible platform vessel 2. As is shown in the figures, a semi-submersible vessel 2 comprises a submergible hull or pontoon section 4, there being two such hulls in the particular embodiment herein described. The pontoons 4, as are well known, are designed for buoyancy and added mass. They contain integral ballast fuel oil, drill water, portable water machinery spaces. Selective pumping of the ballast tanks permits the pontoons 4 to be totally submerged or to be raised to a floating condition for easier transportation of the overall vessel 2 through the water. By design, the displacement of the hulls 4 is controlled, consistent with the overall operational needs of the vessel 2, to establish the overall stability of the vessel 2 which depends upon its metacentric height, which in turn is dependent on the vessel 2 center of gravity.

Arising from the pontoons 4 are a plurality of vertical buoyancy columns 6. Columns 6 serve the the major structural members interconnecting the pontoons 4 with the horizontal work platform 12 of vessel 2. The water plane area of the buoyancy columns 6, that is the sum of the cross-sectional areas of each column 6 at the level of the waterline when the vessel 2 is submerged it to operating draft determines the overall change in buoyancy forces imposed upon the vessel 2 for a given wave action. The overall motion of the vessel 2 is a function of these buoyancy forces, as applied against inertia, which is primarily comprised of the displacement, of the vessel 2, together with the added mass of the water displaced by motion of the vessel 2.

The overall vessel 2 is designed such that a supported work platform or upper deck 12, which is the main structural member on which may be found most of the working equipment, stores, and inhabitable spaces of the vessel 2, is supported an adequate height above wave level such that there is essentially no probability of wave impact to the underside of the upper deck 12 in any sea state likely to be encountered.

Upper deck 12 may be seen to contain, as the most significant dynamic load producing elements upon the vessel 2, at least one crane 14 for moving heavy loads around upper deck 12 and from upper deck 12 to support ships, (not shown). Also shown at the top of upper deck 12 is the drilling rig 16 which further comprises a vertically erect derrick 18 bearing upon the upper deck 12. As is well known, derrick 18 supports a vertical drill string 22 through a drilling table or rotary 20. It is also well know that a drilling rig 16 would include a draw works, not shown here for clarity. The draw works provides motive power and movement to the overall drill string and drill string rotary 20 within the derrick 18.

The drill string rotary 12 is located over a central drilling annulus or moon pool 23, opening through the upper deck 12. Disposed as a downwardly descending annulus about the moon pool 23, penetrating through is a buoyant central caisson 24, which can be seen in this embodiment to ascend to a vicinity of a design plane approximately the top of the hulls 4. The central caisson 24 defines a moon pool extension or inner annulus 26 through which the drill string 22 and the riser column 25 passes and through which drilling operations are performed. The inner annulus 26 and the outer wall of the central caisson 24 define the buoyant caisson annular section 28.

Figure 4:
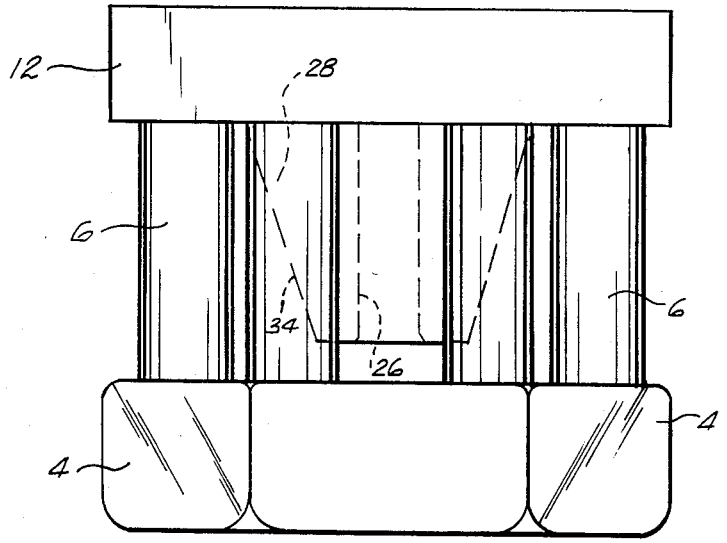
FIG. 4 is a side view of an alternate embodiment of the invention showing an alternate central column construction.

This annular section 28 is preferably used for riser storage 30 replacing the current well known horizontal riser storage areas which have proven to be a primary determinates of the principal dimensions of the overall vessel 2. Within the riser storage area 30 of the caisson annulus 28 may be found racks for vertically storing riser sections 32. By converting the riser storage to a vertical storage, the overall center of gravity of the vessel 2 is lowered, the variable deckload on the upper deck 12 is substantially lowered and the wind loading on the overall vessel 2 is significantly decreased. Caisson 24 is further shown to have an optional angled bottom 34. This angle may be relatively slight as shown in FIG. 2. It may alternatively extend the length of caisson 24 defining an outer inverted conical structure as shown in FIG. 4.

Figure 3:
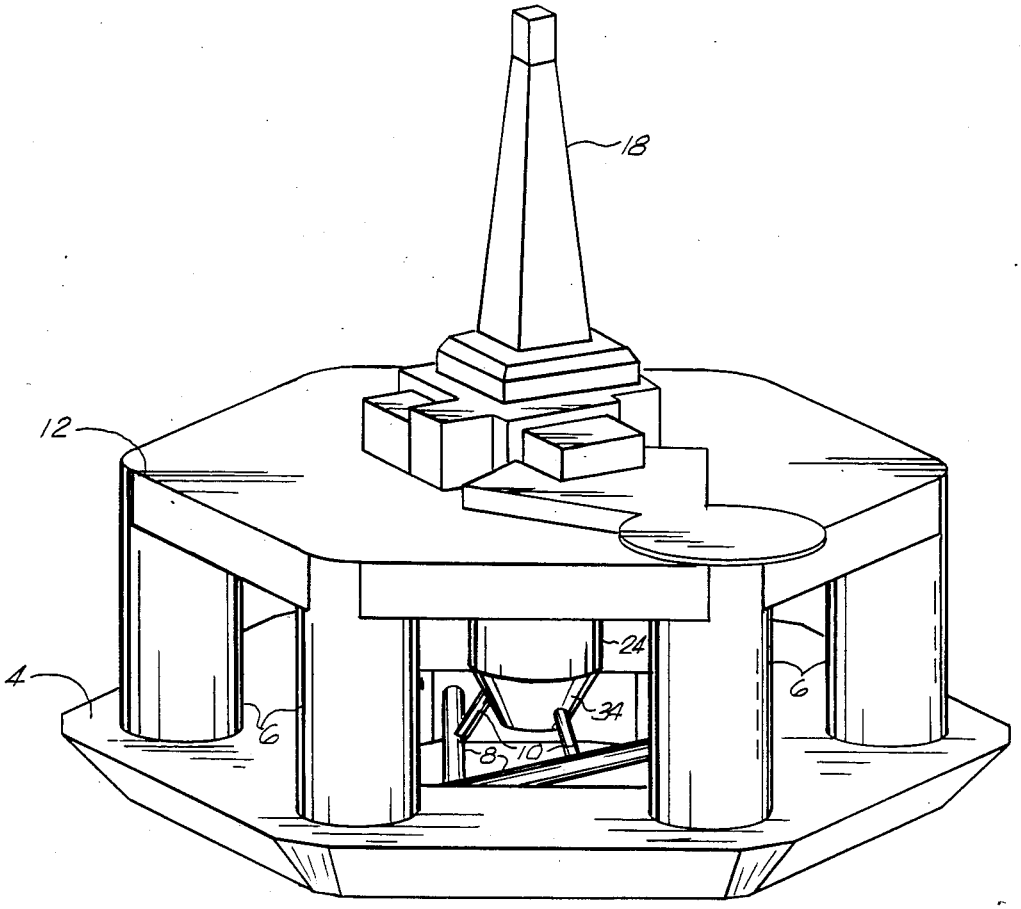
FIG. 3 is an elevated view of an alternate construction of the invention.

FIG. 3 shows an alternate structure for pontoon 4 in which pontoon 4 is an annular polygonal or doughnut shaped structure and the buoyancy columns 6 are equidistantly spaced circumferentially about the single pontoon structure 4.

In operation, the overall vessel 2 is moved either by means of propulsion units installed within the pontoons 4 or by oceangoing tugs to a point of drill operations.

The pontoons 4 are then flooded, in the manner well known to the art, so as to bring the overall vessel 2 to a semi-submerged condition wherein the buoyancy columns 6 pass through the surface of the water, the overall upper deck 12 is supported a distance above the surface of the water so as to be clear of all foreseeable wave impact, and the pontoons 4 are beneath the water in all foreseeable wave conditions.

The vessel 2 is stabilized by means (not shown), over a point of the ocean floor for drilling operations. Seabed drilling operations differ from normal shore drilling operations substantially by the inclusion of a marine rise string connecting a subsea blowout preventor, not shown, mounted on the subsea base on the seabed. The marine riser string rises, as is well known in the art, to a point midway in the inner annulus 26 and is held in tension with respect to and between the vessel 2 and the subsea blowout preventor by means of riser tensioners of standard design, well known in the art. Drillstring 22 passes actually within the marine riser string and within the casing strings within the seabed to the point of drilling within the lower bore hole, all of which structure is well known and not shown. The marine riser string is critical with respect to the vessel to dynamics inasmuch as it is necessary when drilling operations are ceased due to storm conditions and the like that the marine riser be pulled. Since the individual riser sections 32 are extremely large, heavy pieces of pipe, tending to be on the order of four feet diameter pipe, the pulling and handling of the riser sections 32 consumes the majority of the time necessary to pull and also to make up the drilling operation.

It is found that the vertical storage in the marine riser sections 32 within the storage annulus 28 of the caisson 24 significantly increases the handling speed and ease of handling when it is necessary to pull or to set the marine riser. In deep water drilling, this reduces the task which may occupy up to a week to a time of less than one or two days.

As is obvious, seabed drilling successfully requires that the drill bit not shown at the bottom of the drill string 22 be maintained in substantially constant contact with the seabed strata being drilled. Heave of the vessel 2 is particularly critical in this regard inasmuch as heave beyond the amount which can be compensated for by known motion compensators within the drill string and the kelly essentially result in the drill bit being lifted off the bottom of the bore hole reducing significantly the effective speed and control over drilling thus, in order to maintain a constant productive drilling rate, it is necessary to reduce the vessel 2 heave below that amount which can be dampened out by the use of motion compensators of known design.

It is known that for a given sea state all types of vessels 2 will in the presence of very long period waves, on the order of 20 to 22 seconds, achieve a resonance condition in which the platforms will essentially move with the surface crest of the wave and may, in fact due to inertial conditions achieve resonance amplification of the overall wave height, producing a heave greater than the absolute motion of the wave crest. Such conditions, however, exist mainly in storms at sea. These conditions are sufficiently rare and may be forecast with sufficient accuracy and timeliness that drilling operations can be terminated and the marine riser and drill string 22 pulled before the vessel 2 encounters such waves.

Of greater criticality to successful drilling operations from vessel 2 is the fact that the primary contributor to vessel heaving motion appears to be the combination of inertia, primarily due to the overall displacement of the pontoons 4, and the mass of water displaced by pontoon motion, as acted upon by the buoyancy generated by the change in immersion of the individusl buoyancy column 6 during wave passage. These effects in a vessel 2 of normal operating size have significant phase effects. There is a point somewhere in the vicinity of a 10 second period wave where it is found that the typical semi-submersible vessel has a peak heave sensitivity due to an out of phase condition between the buoyancy forces created by the buoyancy columns 6 and the inertia responses stated above.

The buoyant annulus 28 of the central caisson 24 of the current invention appears to interrupt and change the overall phase relationship of the buoyancy and inertia effects aforesaid so as to significantly decrease the maximum heave amplitude in all sea state conditions below resonance. It appears that the addition of central buoyant cassion 24 will permit the use of vessel 2 for drilling operations under all sea states below resonance by sufficiently damping the heave.

It has, however, been observed that the addition of central column 24 makes the vessel in the two hull embodiment heretofore described differentially sensitive to pitch and to roll, that is, the vessel 2 will exhibit an increased sensitivity either to head or to beam seas depending upon the exact configuration. For this reason, an alternative configuration of vessel 2, shown in FIG. 4, is envisioned whereby, for certain versions of the instant invention, a symmetrical pontoon 4 and column 6 structure is disposed about the drill rig 16 and the central caisson 24. It should be noted in this regard that neither the pontoon(s) 4, the column(s) 6, nor the caisson 24 need be cylindrical. This structure will be stable to seas from all directions.

Other operations having a significant effect upon the motion of the vessel 2 include operations by crane 14. Crane 14 is located so as to be capable of moving loads from any point upon work platform 12 to any other point upon work platform 12 and also to points alongside vessel 2 such as for underway replenishment or delivery operations. Thus, crane 14 is normally found to be far off center of the center of gravity of the overall vessel 2 and additionally may add a significant lever arm to the loads being raised. Dynamic effects of crane 14 include the effects of transitioning heavy loads around the vessel 2, significantly altering its center of gravity and its overall list. Crane 14 also will contribute significant dynamic impact to the vessel 2 if it should suddenly snatch or drop a load.

A separate significant problem with the operation of drilling off vessels 2 is the requirement for the storage of the riser sections 32 which make up the marine riser. In deep sea drilling operations well over 6,000 feet of marine riser may be stored on the vessel 2 since it must always be possible to trip out the riser.

It has heretofore been customary to store these pipe sections 32 in horizontal riser storage atop the work platform 12. This storage is required since the combined work of crane 14 and derrick 18 are required to move, manipulate nd handle the riser sections 32, which may be 4 feet in diameter steel pipe sections, during normal operations.

The horizontal storage of this much riser atop the work platform 12 tends to decrease the dynamic and static stability of the overall vessel 2. The static stability is decreased by the significant rise in the center of gravity due to the top heavy storage of large amounts of heavy pipe sections at one of the higher points of the vessel 2. The dynamic stability of the overall vessel 2 is decreased by the combined effects of the increased wind loading imposed by the storage of this quantity of riser 32 at a lever arm well removed from the metacentric height of the vessel 2 as well as the asymmetrical weight distribution imposed by the movement of this much riser during operations involving tripping out or reinsertion of the drill string 22.

It is therefore an additional advantage of the instant invention that the buoyant caisson annulus 28 provides, in addition to direct improved dynamic stability in heave, additional stability by providing a riser storage area 30. It is no longer necessary that the riser sections 32 comprising the marine riser be moved from the vertical position while the marine riser is being made up or pulled out. The necessity for complex mechanical devices for handling large riser sections 32 in an underway conditions, including the problems involved in moving sections of riser from a vertical position within the derrick 18 to a horizontal position for stowage and movement atop the work platform 12, are now eliminated. Inasmuch as the buoyant caisson annulus 28 is symmetrically located about the base of the derrick 18, riser storage 30 can be directly loaded with riser sections 32 by lowering the individual riser sections 32 vertically using the derrick 18 apparatus. Since each section of riser 32 is maintained always in a vertical condition, handling speed is significantly increased, safety is increased, and the amount of handling equipment required is significantly reduced. Further, the center of gravity of the riser sections 32 while stored in riser storage 30 is lowered significantly from that of a horizontal storage rack atop work platform 12. The riser storage 30 center of gravity more closely approaches the overall center of gravity of the platform vessel 2 and, since riser storage 30 is symmetrically disposed about the drilling center of the platform, asymmetrical or differential loadings are nearly eliminated. Thus dynamic effects of riser handling upon the motion of the overall vessel 2 are largely eliminated by the central column 24 storage of the riser sections 32.

In combination then, the instant invention significantly reduces undesirable motion of the vessel 2 within a seaway by a combination of reducing the direct heave sensitivity of the vessel 2 in sea states below resonance, and in addition, by reducing or largely eliminating the dynamic effect due to the movement of the largest variable mass component of the overall vessel 2: the marine riser.

It can thus be seen from the above description that the instant invention comprises not only the specific preferred embodiment described in detail above but a large number of equivalent structures all suitable as semi-submersible vessels for stable operations offshore. The invention therefore, is more correctly reflected in the claims which follow.

I claim:

1. An improved semi-submersible vessel for supporting drilling operations at sea, the vessel being movable between a low draft condition in which the vessel is transported and an operational high draft condition in which drilling operations occur, the vessel comprising:

at least one submersible pontoon;

a work platform above the pontoon;

a plurality of outer vertically extending buoyant columns supportably extending upward from the pontoon and providing the major, structural support for maintaining the pontoon in spaced relationship to the work platform; and a centrally disposed buoyant caisson extending downward from the work platform to a point below the waterline level of the vessel when submerged to an operational draft, the caisson extending downwardly a sufficient distance to always intersect the wave surface at operational draft, such that the water plane area of the central caisson provides a major contribution to reducing heave of the vessel by creating an out of phase condition between buoyancy forces of the column and inertia responses of the pontoon at high draft in waves of normally expected periods.

2. An improved semi-submersible vessel for supporting drilling operations at sea, the vessel being movable between a low draft condition in which the vessel is transported and an operational high draft condition in which drilling operations occur, the vessel comprising:

at least one submersible pontoon structure;

a plurality of outer vertically extending buoyant columns supportably extending upwards from the pontoon and providing the major, structural support for maintaining the pontoon in spaced relationship to a work platform mounted on top of the vertical columns; and a centrally disposed buoyant caisson extending downward from the work platform to a point below the waterline level of the vessel when submerged to operational draft, the caisson extending downwardly a sufficient distance to always intersect the wave surface at operational draft, wherein the central caisson is in surrounding relationship to a drill center of the vessel.

3. An apparatus as described in claim 2 above wherein said central buoyant caisson is a downwardly extending, inwardly tapering truncated conical outer section.

4. An apparatus as described in claim 2 above wherein said outer vertical buoyant columns are symmetrically disposed about a longitudinal axis of the vessel.

5. An apparatus as described in claim 2 above wherein said outer vertical buoyant columns are symmetrically disposed about the vertical axis of said central buoyant caisson.

6. An apparatus as described in claim 5 wherein said pontoon structure further comprises a single, symmetrical, polygonal annulus.

7. An improved semi-submersible vessel for supporting drilling operations at sea, the vessel being movable between a low draft condition in which the vessel is transported and an operational high draft condition in which drilling operations occur, the vessel comprising:

a platform supported by at least one submersible pontoon held in spaced relationship to the platform by a plurality of outside columns; and a central buoyant caisson extending vertically downward from the work platform to a point below the waterline level of the vessel when submerged to operating draft, the water plane area of the outside columns at operational draft being at least as great as the water plane area of the central caisson, and the central caisson extending downwardly a sufficient distance to always intersect the wave surface at operational draft, such that the water plane area of the central caisson provides a major contribution to reducing heave of the vessel at high draft in waves of normally expected periods, the central caisson being in surrounding relationship to a drill center of the platform.

8. The vessel of claim 7 wherein riser pipe is vertically stored within the buoyant caisson.

9. The vessel of claim 8 wherein the riser pipe is stored completely below a floor of the platform.

10. The vessel of claim 7 wherein the outside columns provide the major structural support for holding the pontoons and platform in spaced relationship.

11. An improved semi-submersible vessel for supporting drilling operations at sea, comprising:

a platform having a drill center, the platform being supported by at least one submersible pontoon held in spaced relationship to the platform by a plurality of outside columns which provide the major structural support for holding the pontoon and platform in spaced relationship, the water plane area of the outside columns at operational draft being at least as great as the water plane area of the columns immediately above the pontoons; and a central, buoyant caisson extending vertically downward from the work platform in surrounding relationship to the drill center to a point below the waterline level of the vessel when submerged to operating draft.

12. The vessel of claim 11 wherein riser pipe is vertically stored within the buoyant caisson.

13. The vessel of claim 12 wherein the riser pipe is stored completely below a floor of the platform.

* * * * *